US006589009B1

(12) United States Patent
Shiokawa et al.

(10) Patent No.: US 6,589,009 B1
(45) Date of Patent: Jul. 8, 2003

(54) TURBO-MOLECULAR PUMP

(75) Inventors: Atsushi Shiokawa, Tokyo (JP); Matsutaro Miyamoto, Tokyo (JP); Hiroyuki Kawasaki, Tokyo (JP); Hiroshi Sobukawa, Tokyo (JP); Hiroaki Ogamino, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/592,411

(22) Filed: Jun. 13, 2000

Related U.S. Application Data

(63) Continuation-in-part of application No. 09/473,137, filed on Dec. 28, 1999, which is a continuation-in-part of application No. 09/104,171, filed on Jun. 25, 1998.

(30) Foreign Application Priority Data

Jun. 14, 1999 (JP) ..... 11-166637

(51) Int. Cl.[7] ..... F04D 19/04

(52) U.S. Cl. ..... 415/90; 415/9; 415/143; 415/200

(58) Field of Search ..... 415/9, 90, 121.2, 415/143, 200; 417/423.4

(56) References Cited

U.S. PATENT DOCUMENTS 4,309,143 A * 1/1982 Klatt et al. ..... 415/90
4,579,508 A * 4/1986 Tsumaki et al. ..... 415/90
4,787,829 A * 11/1988 Miyazaki et al. ..... 415/90
5,528,618 A * 6/1996 Schlie et al. ..... 415/90

FOREIGN PATENT DOCUMENTS

| | | | | |
|---|---|---|---|---|
| DE | 2549700 A | * | 11/1976 | ..... 417/423.4 |
| EP | 0 332 107 A1 | | 9/1989 | |
| JP | 64-29695 A | * | 1/1989 | ..... 417/423.4 |
| JP | 1-190991 A | * | 8/1989 | ..... 415/90 |
| JP | 8-68389 | | 3/1996 | |
| JP | 10-252684 | | 9/1998 | |
| JP | 11-93889 | | 4/1999 | |

* cited by examiner

*Primary Examiner*—Christopher Verdier
(74) *Attorney, Agent, or Firm*—Armstrong, Westerman & Hattori, LLP

(57) ABSTRACT

A turbo-molecular pump includes a casing having an intake port, a stator fixedly mounted in the casing, and a rotor supported in the casing for rotation relatively to the stator. The stator and the rotor make up a turbine blade pumping section and a groove pumping section for evacuating gas. A scattering prevention member is provided for preventing fragments of the rotor from being scattered through the intake port.

4 Claims, 18 Drawing Sheets

TURBO-MOLECULAR PUMP

This is a continuation-in-part of application Ser. No. 09/473,137, filed Dec. 28, 1999, which is a continuation-in-part of Ser. No. 09/104,171 filed Jun. 25, 1998.

BACKGROUND OF THE INVENTION

1. Field of the Invention

The present invention relates to a turbo-molecular pump for evacuating gas with a rotor that rotates at a high speed.

2. Description of the Related Art

FIG. 21 of the accompanying drawings shows a conventional turbo-molecular pump. As shown in FIG. 21, the conventional turbo-molecular pump comprises a rotor R and a stator S which are housed in a pump casing 14. The rotor R and the stator S jointly make up a turbine blade pumping section L1 and a thread groove pumping section L2. The stator S comprises a base 15, a stationary cylindrical sleeve 16 vertically mounted centrally on the base 15, and stationary components of the turbine blade pumping section L1 and the thread groove pumping section L2. The rotor R mainly comprises a main shaft 10 inserted coaxially in the stationary cylindrical sleeve 16, and a rotary cylindrical sleeve 12 mounted on the main shaft 10 and disposed around the stationary cylindrical sleeve 16.

Between the main shaft 10 and the stationary cylindrical sleeve 16, there are provided a drive motor 18, an upper radial magnetic pole 20 disposed above the drive motor 18, and a lower radial magnetic pole 22 disposed below the drive motor 18. An axial bearing 24 is disposed at a lower portion of the main shaft 10, and comprises a target disk 24*a* mounted on the lower end of the main shaft 10, and upper and lower electromagnets 24*b* provided on the stator side. By this magnetic bearing system, the rotor R can be rotated at a high speed under 5-axis active control.

The rotary cylindrical sleeve 12 has rotor blades 30 integrally disposed on an upper outer circumferential portion thereof. In the pump casing 14, there are provided stator blades 32 disposed axially alternately with the rotor blades 30. The rotor blades 30 and the stator blades 32 jointly make up the turbine blade pumping section L1 for evacuating gas by way of an interaction between the rotor blades 30 and the stator blades 32.

The thread groove pumping section L2, which is disposed downwardly of the turbine blade pumping section L1, includes a thread groove section 34 of the rotary cylindrical sleeve 12 which has thread grooves 34*a* defined in an outer circumferential surface thereof and surrounds the stationary cylindrical sleeve 16. The stator S has a spacer 36 disposed around the thread groove section 34. The thread groove pumping section L2 evacuates gas by way of a dragging action of the thread grooves 34*a* in the thread groove section 34 which rotates at a high speed in unison with the rotor R. The stator blades 32 have outer edges clamped by either stator blade spacers 38 or the stator blade spacer 38 and the spacer 36.

With the thread groove pumping section L2 disposed downstream of the turbine blade pumping section L1, the turbo-molecular pump is of the wide range type capable of handing a wide range of rates of gas flows. In the conventional turbo-molecular pump shown in FIG. 21, the thread grooves 34*a* of the thread groove pumping section L2 are defined in the rotor R. However, the thread grooves of the thread groove pumping section L2 may be defined in the stator S.

In such a turbo-molecular pump, if the rotor R is broken due to corrosion or the like, then fragments of the rotor R may enter an intake port 14*a* of the pump casing 14. When fragments of the rotary cylindrical sleeve 12 or the rotor blades 30 which have large kinetic energy are introduced into the chamber of a processing apparatus that is connected to the intake port 14*a* of the pump casing 14 through a flange 14*b*, the processing apparatus may be broken or products that are being processed by the processing apparatus may be damaged, and the overall evacuating system may be destroyed, tending to cause a harmful processing gas to leak into the surrounding environment.

SUMMARY OF THE INVENTION

It is therefore an object of the present invention to provide a highly safe turbo-molecular pump which can prevent rotor fragments from damaging the chamber in a processing apparatus and products being processed by the processing apparatus even when a rotor of the turbo-molecular pump is broken, and which can be replaced in its entirety in case of destruction for quickly making the processing apparatus reusable.

According to the present invention, there is provided a turbo-molecular pump comprising a casing having an intake port, a stator fixedly mounted in the casing, a rotor supported in the casing for rotation relatively to the stator, the stator and the rotor serving as at least one of a turbine blade pumping section and a thread groove pumping section for evacuating gas, and a scattering prevention member for preventing fragments of the rotor from being scattered through the intake port.

If the rotor is broken, then fragments of the rotor, e.g., a rotary cylindrical sleeve and rotor blades, or fragments of the stator, e.g., stator blades, are blocked by the scattering prevention member, or lose the kinetic energy toward the intake port. Therefore, the scattering prevention member is effective to prevent those fragments from damaging the chamber in a processing apparatus connected to the intake port or devices and products being processed in the chamber. The scattering prevention member may be mounted on a stationary member such as the casing, or the rotor.

The rotor comprises rotor blades and the stator comprises stator blades, and the scattering prevention member comprises at least part of the rotor blade or the stator blade. Therefore, at least part of the rotor blade or the stator blade has a fragment shield function.

The scattering prevention member includes at least one protrusion projecting radially inwardly from an inner surface of the intake port. If the rotor is broken, rotor fragments collide with the protrusion, and are prevented from being scattered through the intake port or kinetic energy of the rotor fragments is reduced.

The scattering prevention member is made of a high-strength material and/or a high-energy absorbing material. The high-strength material may be stainless steel, titanium alloy, or the like which is stronger than aluminum. The high-energy absorbing material may be made of a relatively soft metal material such as lead, a polymer material, or a composite material thereof, and shaped so as to be effective to absorb shocks, e.g., shaped into a honeycomb structure or an assembly of spherical members.

The scattering prevention member has a shock absorbing structure. The shock absorbing structure is effective to absorb the kinetic energy of rotor fragments which collide with the scattering prevention member for better protection of the chamber in the processing apparatus that is connected to the intake port.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 21:
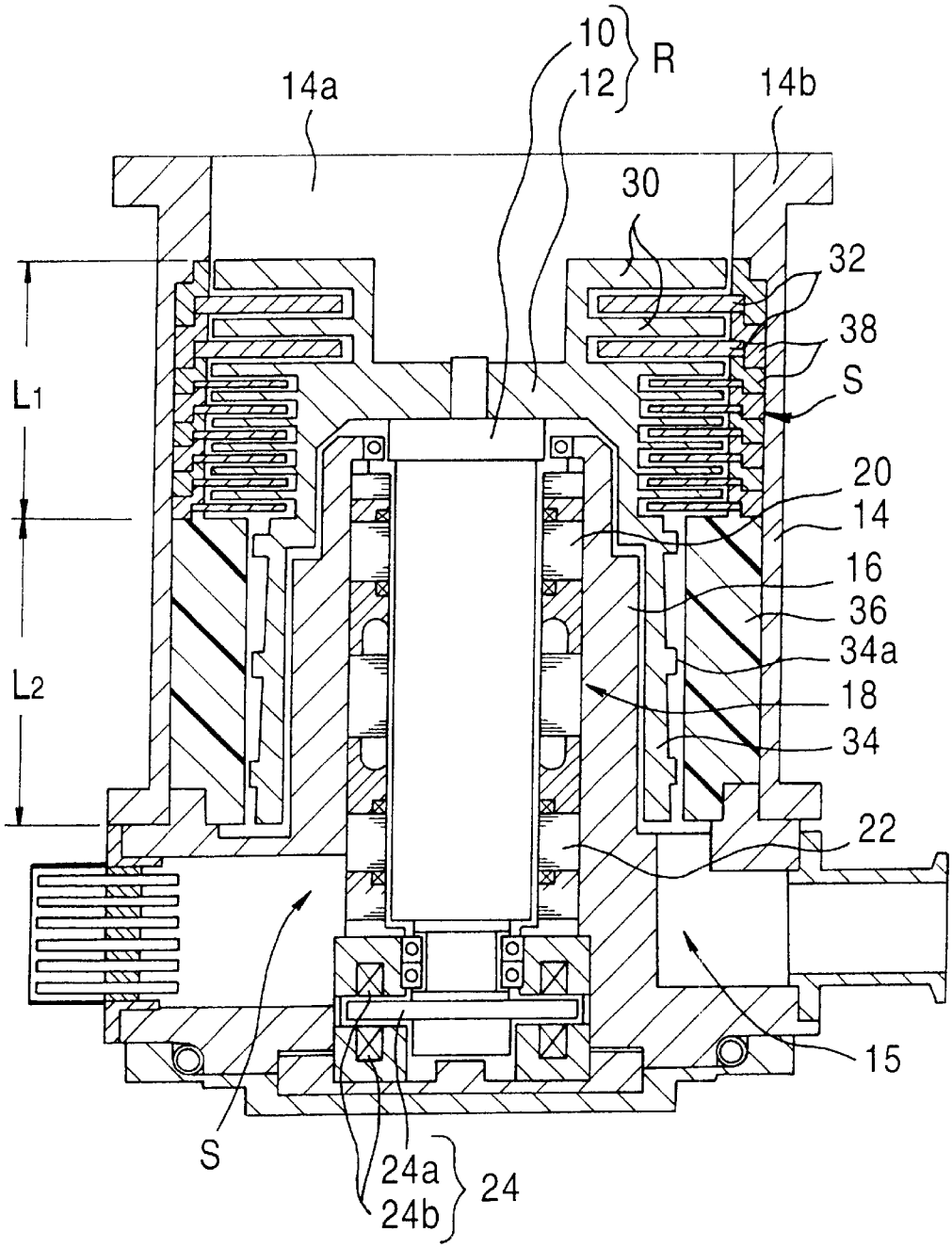
FIG.21 PRIOR ART
FIG. 21 is an axial cross-sectional view of a conventional turbo-molecular pump.

Next, a turbo-molecular pump according to embodiments of the present invention will be described below. Like or corresponding parts are denoted by like or corresponding reference characters throughout views. Those parts of turbo-molecular pumps according to the present invention which are identical to those of the conventional turbo-molecular pump shown in FIG. 21 are denoted by identical reference characters, and will not be described in detail below.

Figure 1:
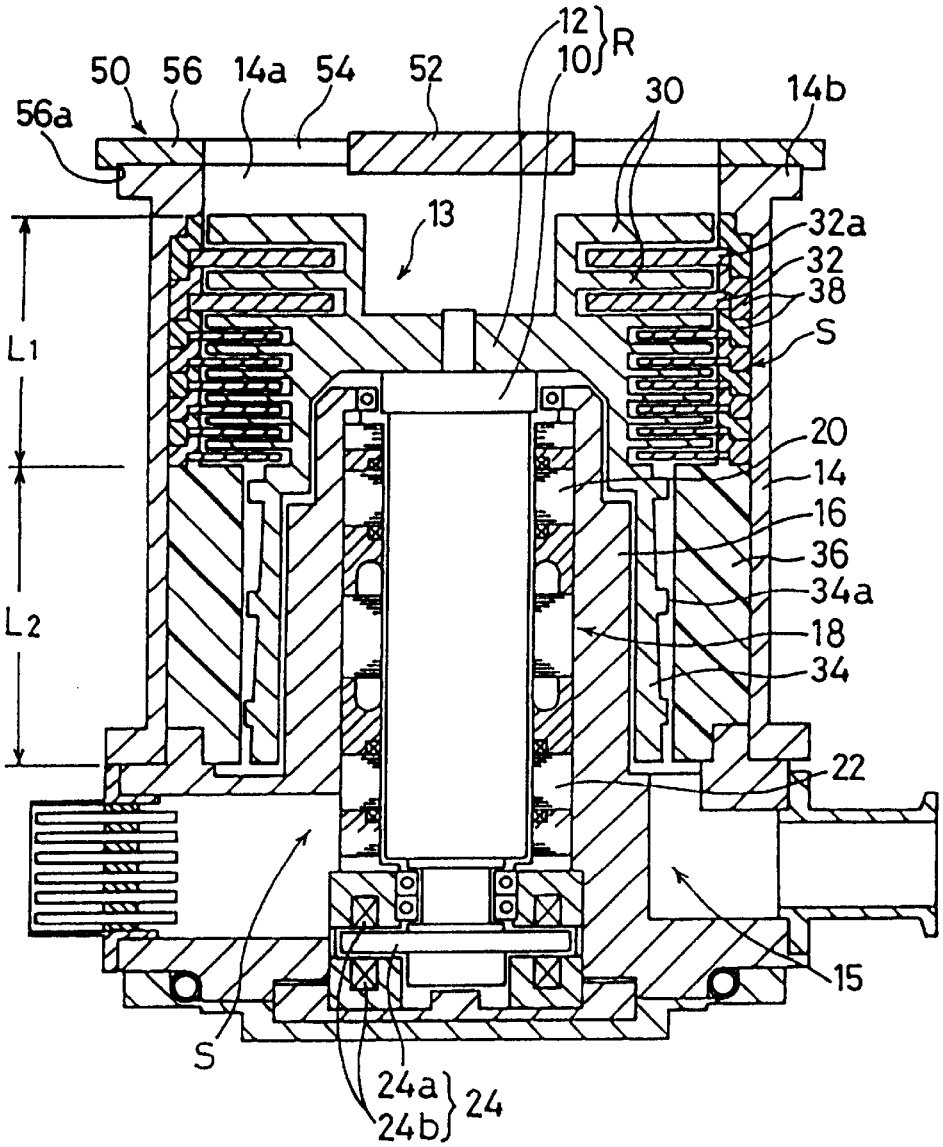
FIG. 1 is an axial cross-sectional view of a turbo-molecular pump according to a first embodiment of the present invention.
Figure 2:
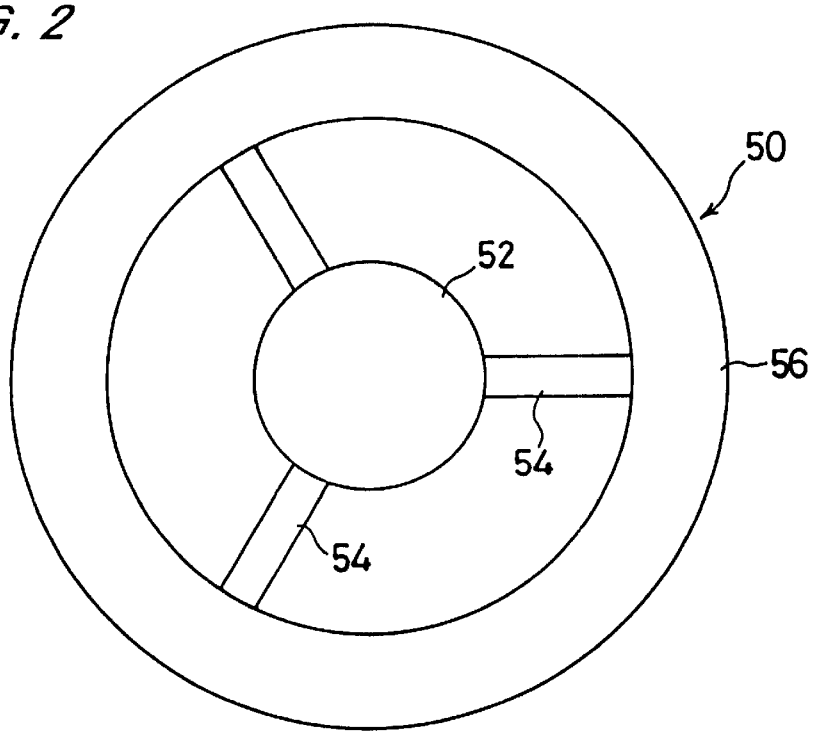
FIG. 2 is a plan view of the turbo-molecular pump shown in FIG. 1.

FIGS. 1 and 2 show a turbo-molecular pump according to a first embodiment of the present invention. As shown in FIGS. 1 and 2, the turbo-molecular pump according to the first embodiment has a protective cover 50 serving as a scattering prevention member mounted on the flange 14*b* around the intake port 14*a* in the pump casing 14. The protective cover 50 comprises a circular shield 52 disposed centrally in the intake port 14*a* in covering relationship to an area directly above the rotary cylindrical sleeve 12 of the rotor R, a ring-shaped rim 56 disposed concentrically with and radially outwardly of the circular shield 52 and having an opening whose size is the same as the size of the intake port 14*a,* and a plurality of (three in FIG. 2) support bars 54 extending radially outwardly from the circular shield 52 to connect the circular shield 52 and the rim 56 to each other. In FIG. 1, the protective cover 50 has a step 56*a* on the lower surface of the rim 56 which is fitted over the flange 14*b,* so that the protective cover 50 is fixed to the pump casing 14. However, the flange 14*b* may have a step, and the protective cover 50 may be fitted in the step and fastened to the flange 14*b* by bolts. Alternatively, the protective cover 50 may be fitted in the step in the flange 14*b* and simply sandwiched between the pump casing 14 and the chamber in the processing apparatus to which the turbo-molecular pump is connected.

The axially uppermost stator blade 32*a* of all the stator blades 32 is made of a material stronger than aluminum, such as stainless steel, titanium alloy, or the like, and the remaining stator blades 32 are made of aluminum. Thus, the stator blade 32*a* also serves as a scattering prevention member.

With the turbo-molecular pump having the above structure, if the rotor R is broken due to corrosion or the like while it is rotating, fragments of the rotary cylindrical sleeve 12 or the rotor blades 30 in the rotor R collide with the shield 52 of the protective cover 50, thereby losing their kinetic energy toward the intake port 14*a.* Therefore, the chamber or the like connected to the intake port 14*a* of the pump casing 14 is prevented from being damaged, or the degree of damage of the chamber or the like is reduced. In the embodiment shown in FIG. 1, the shield 52 covers only the rotary cylindrical sleeve 12. However, the shield 52 may cover not only the rotary cylindrical sleeve 12, but also part of the rotor blades 30.

Since the axially uppermost stator blade 32*a* of the stator blades 32 is made of a material stronger than aluminum, the stator blade 32*a* is not broken or is broken to a lesser degree when it is hit by fragments of the rotor blades 30 made of aluminum. The stator blade 32*a* thus effectively serves as a scattering prevention member for preventing fragments from being scattered through the intake port 14*a*.

In the first embodiment, only the uppermost stator blade 32*a* of the stator blades 32 is made of a high-strength material. However, any other arbitrary stator blades 32, e.g., first- and fourth-stage stator blades 32 may be made of a high-strength material. This holds true for other embodiments of the present invention.

In the first embodiment, the protective cover 50 is provided as a scattering prevention member, and also the uppermost stator blade 32*a* of the stator blades 32 is made of a material stronger than aluminum as a scattering prevention member. However, either protective cover 50 may be provided or the uppermost stator blade 32*a* may be made of a material stronger than aluminum. The turbo-molecular pump in other embodiments described later may have the same structure as the turbo-molecular pump in the first embodiment.

Figure 3:
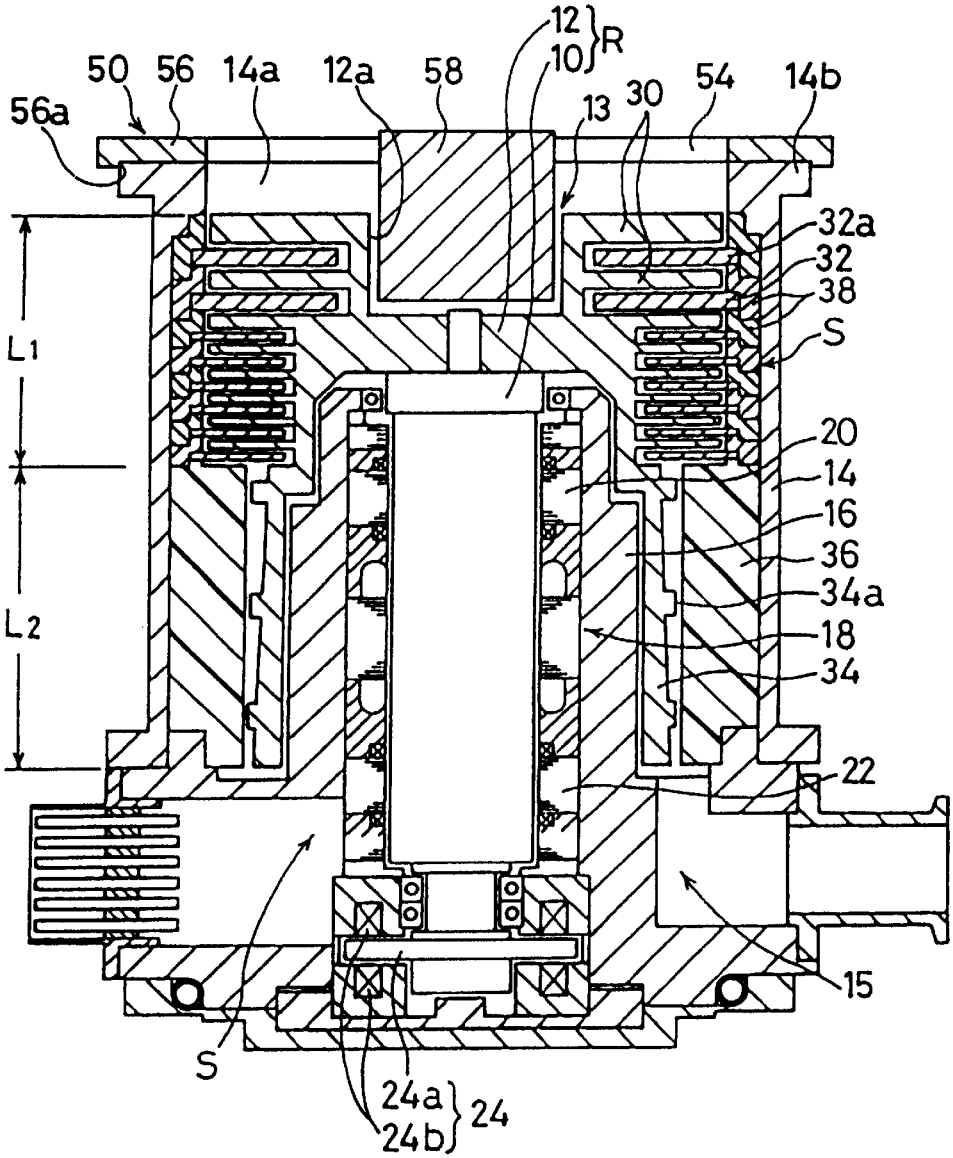
FIG. 3 is an axial cross-sectional view of a turbo-molecular pump according to a second embodiment of the present invention.

FIG. 3 shows a turbo-molecular pump according to a second embodiment of the present invention. According to the second embodiment, the circular shield 52 of the protective cover 50 according to the first embodiment is replaced with a substantially cylindrical shield 58. The substantially cylindrical shield 58 has a substantially lower half disposed in a recess 13 defined centrally in the rotary cylindrical sleeve 12. Other details of the turbo-molecular pump according to the second embodiment are identical to those of the turbo-molecular pump according to the first embodiment.

With the turbo-molecular pump according to the second embodiment, the gap between the shield 58 and the rotor R is reduced to lower the possibility of fragments to be scattered around for better protection of the chamber to which the turbo-molecular pump is connected. The shield 58 also performs an attitude maintaining function to keep the rotor R in its proper attitude when the rotor R suffers abnormal rotation. Any unwanted contact between the rotor R and the stator W can therefore be minimized to reduce the possibility of fragment production.

Figure 4:
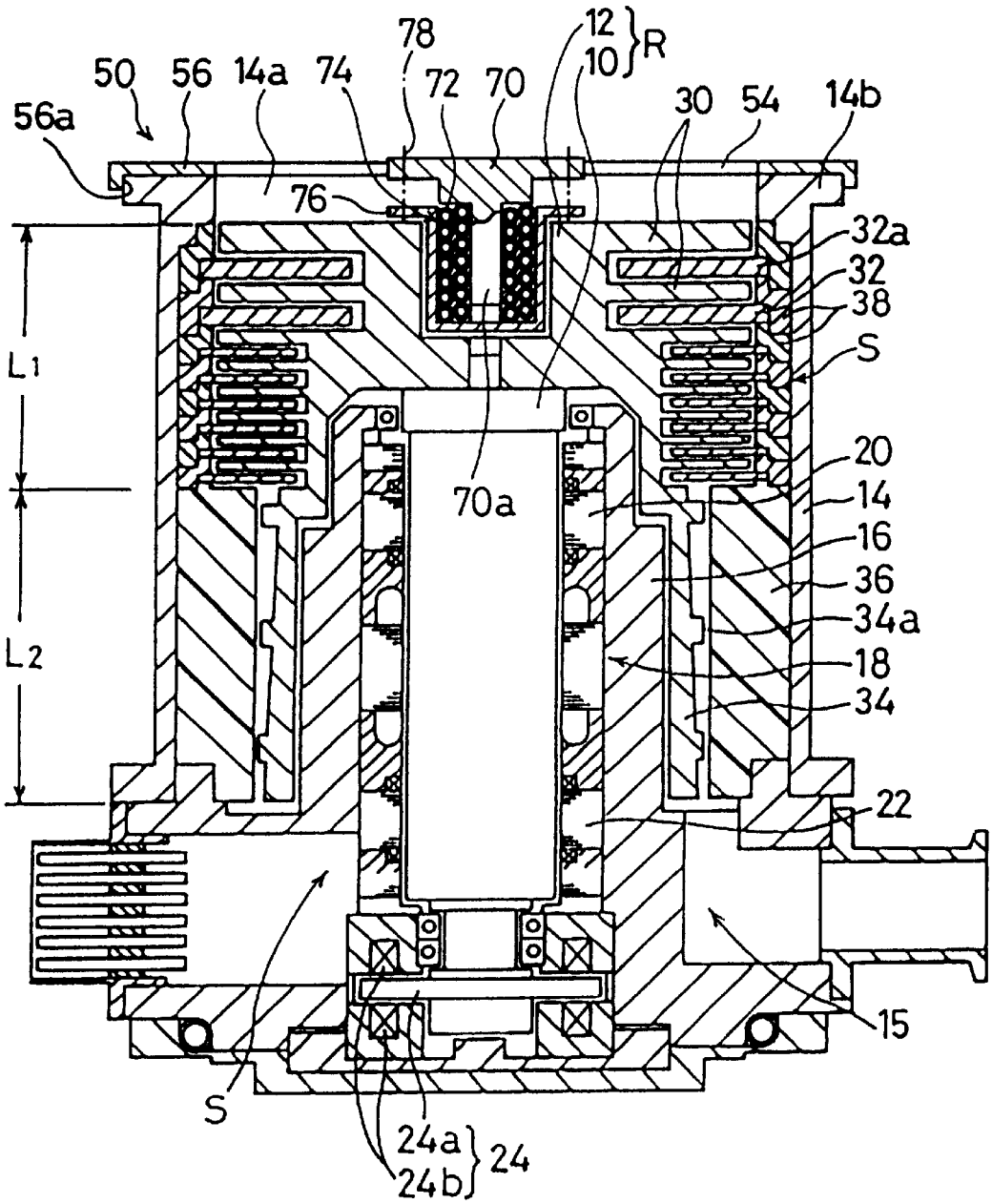
FIG. 4 is an axial cross-sectional view of a turbo-molecular pump according to a third embodiment of the present invention.
Figure 5:
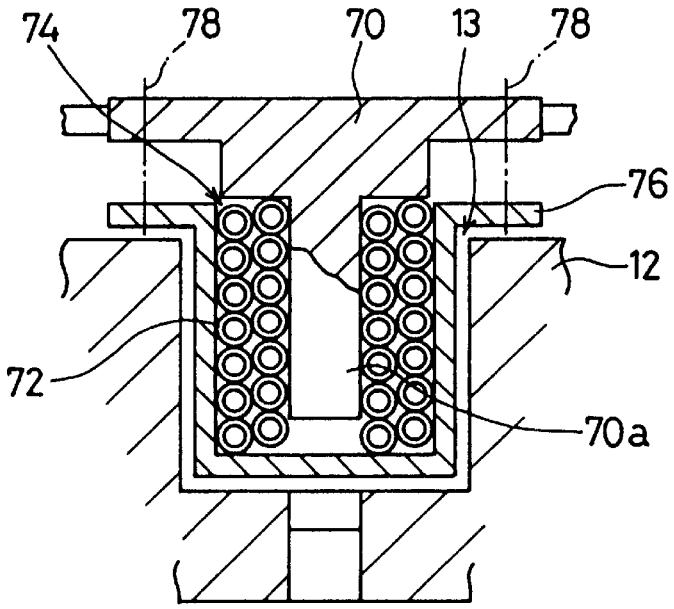
FIG. 5 is an enlarged fragmentary cross-sectional view of the turbo-molecular pump shown in FIG. 4.

FIGS. 4 and 5 shows a turbo-molecular pump according to a third embodiment of the present invention. According to the third embodiment, the turbo-molecular pump includes a scattering prevention member having a shock absorbing structure. Specifically, the protective cover 50 as a scattering prevention member has a substantially circular shield 70 disposed centrally therein and having a shank 70*a* projecting downwardly, and a shock absorbing member 74 comprising metal pipes 72 wound in two coil-like layers around the shank 70*a*. The shock absorbing member 74 is surrounded by a cup-shaped cover 76 which is open upwardly. The shield 70 has a peripheral edge fastened to a flange of the cover 76 by bolts 78. The cover 76 is disposed so as to enter the recess 13 defined centrally in the rotary cylindrical sleeve 12.

With the turbo-molecular pump of this embodiment, if the rotor R is broken, then fragments of the rotor blades 30 or the rotary cylindrical sleeve 12 collide with the shield 70 and the cover 76. At this time, the shock absorbing member 74 can easily be deformed or broken in both axial and radial directions to absorb applied shocks. Therefore, the kinetic energy of the fragments is absorbed to protect the chamber to which the turbo-molecular pump is connected.

The shock absorbing member 74 may alternatively be made of a relatively soft metal material such as lead, a polymer material, or a composite material thereof, and shaped so as to be effective to absorb shocks, e.g., shaped into a honeycomb structure or an assembly of spherical members. In view of applications of the turbo-molecular pump for evacuating corrosive gases, the shock absorbing member 74 should preferably be made of a corrosion-resistant material or be treated to provide a corrosion-resistant surface such as a nickel coating.

Figure 7:
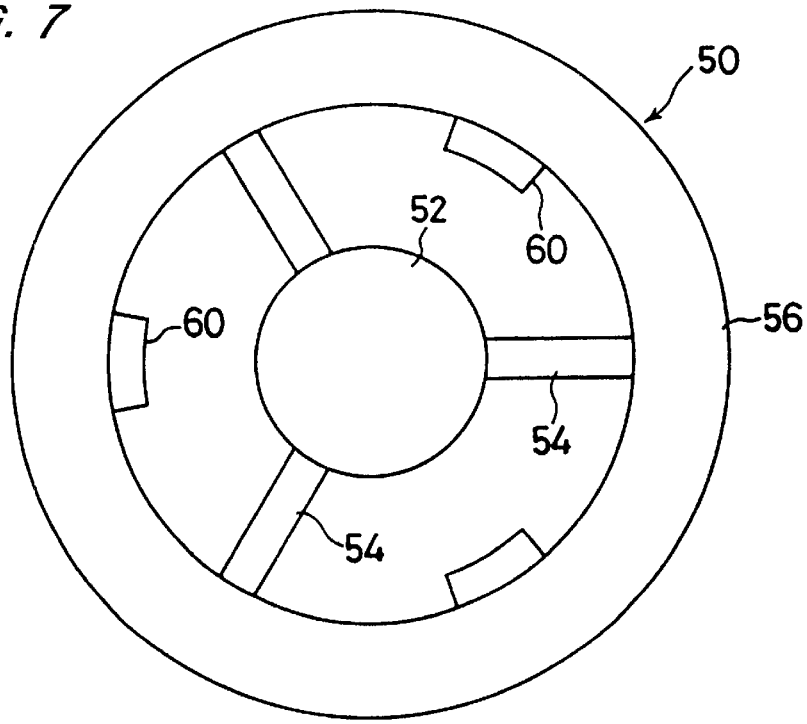
FIG. 7 is a plan view of the turbo-molecular pump shown in FIG. 6.
Figure 6:
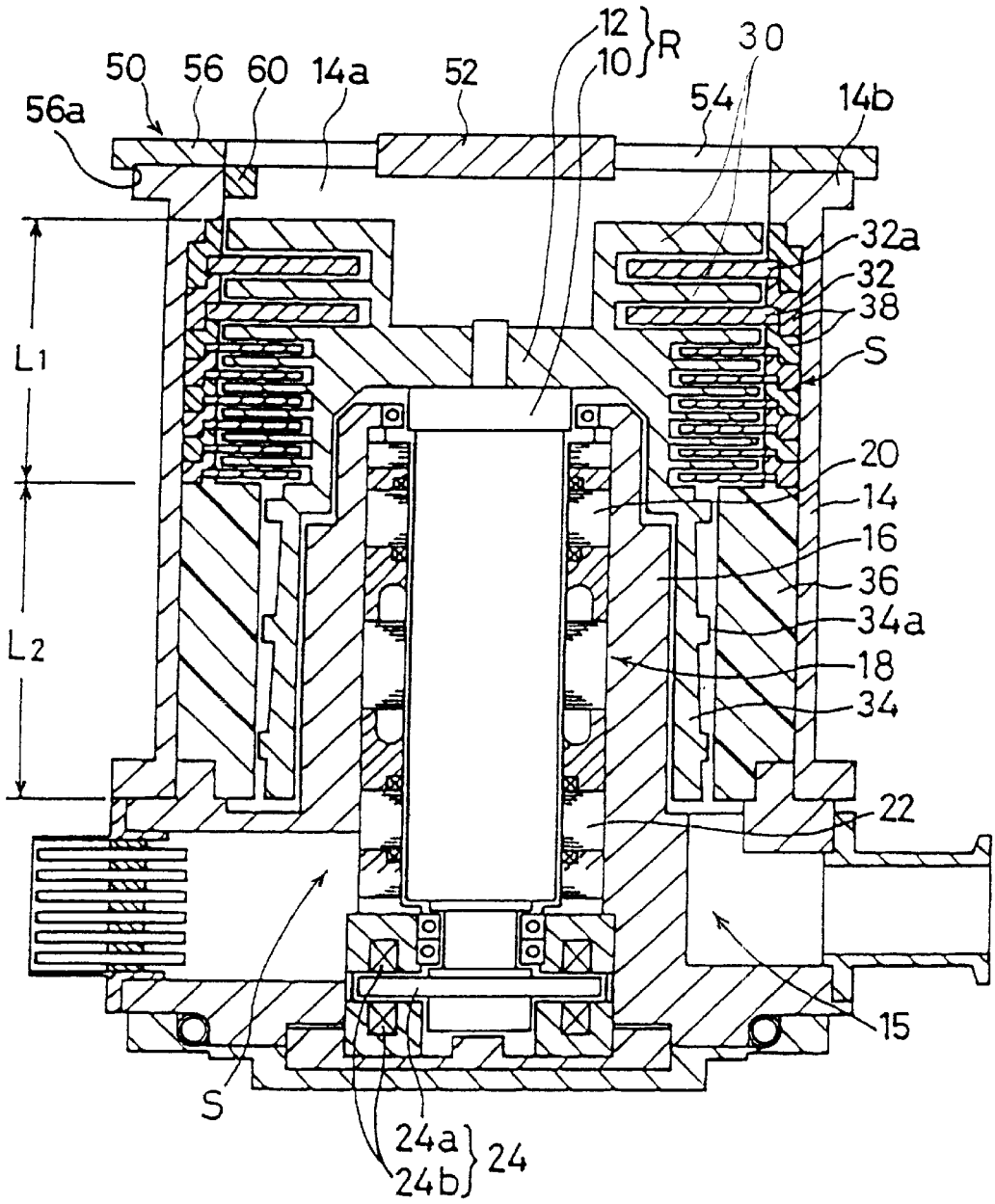
FIG. 6 is an axial cross-sectional view of a turbo-molecular pump according to a fourth embodiment of the present invention.

FIGS. 6 and 7 show a turbo-molecular pump according to a fourth embodiment of the present invention. The turbo-molecular pump according to the fourth embodiment differs from the turbo-molecular pump according to the first embodiment in the following: A plurality of (three in FIG. 7) protrusions 60, which make up a scattering prevention member together with the protective cover 50, are disposed at predetermined intervals on an inner surface of the intake port 14*a* and project radially inwardly in covering relationship to the outer circumferential edges of the rotor blades 30 of the rotor R. While the protrusions 60 are shown as being disposed on the inner surface of the intake port 14*a,* the protrusions 60 may alternatively be disposed on the rim 56 of the protective cover 50.

With the turbo-molecular pump according to the fourth embodiment, if the rotor R is broken, then fragments of the rotor blades 30 and the rotary cylindrical sleeve 12 collide with not only the shield 52 but also the protrusions 60, thus reducing the kinetic energy of the fragments introduced into the intake port 14*a*.

Figure 8:
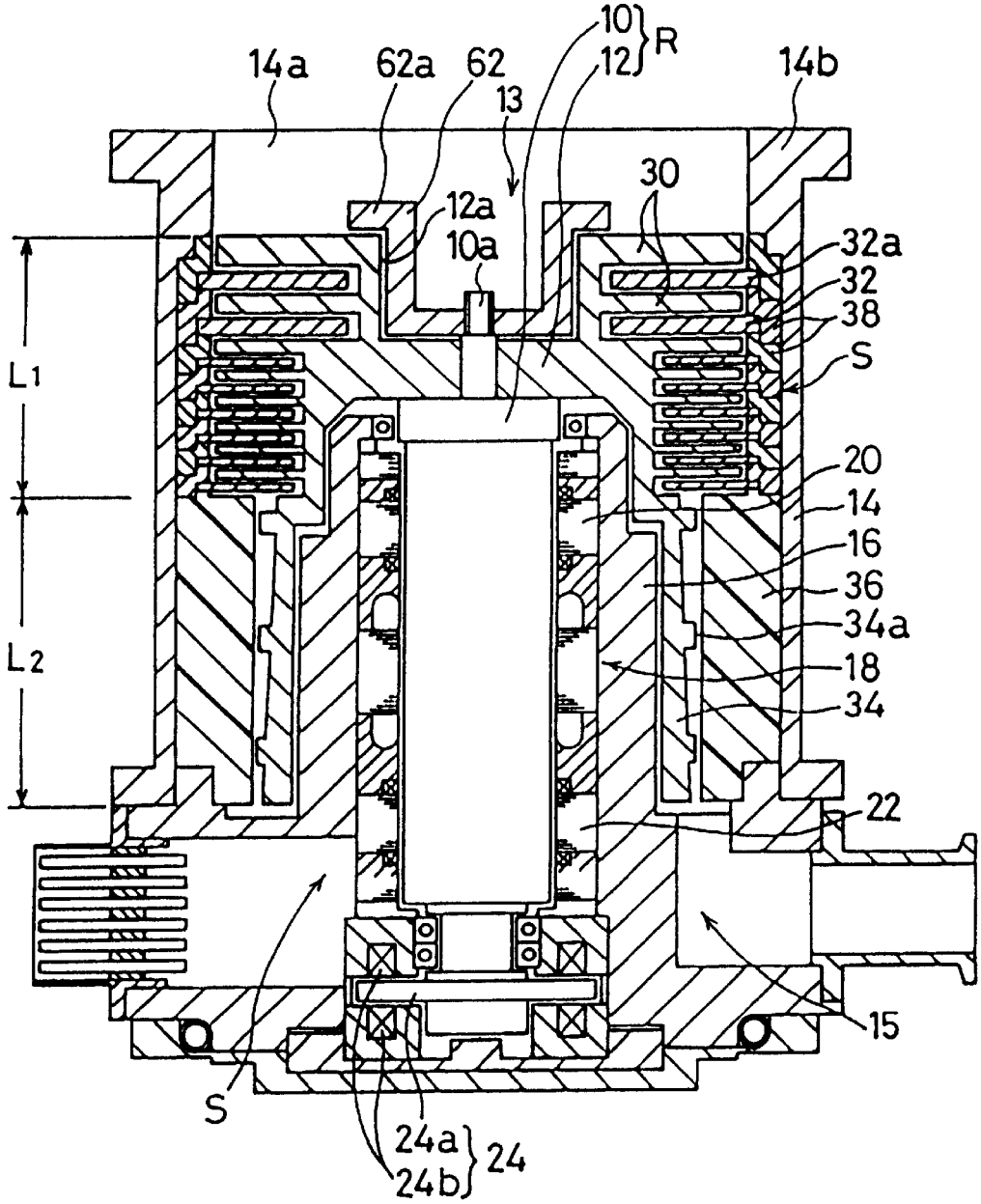
FIG. 8 is an axial cross-sectional view of a turbo-molecular pump according to a fifth embodiment of the present invention.

FIG. 8 shows a turbo-molecular pump according to a fifth embodiment of the present invention. The turbo-molecular pump according to the fifth embodiment has a scattering prevention member 62 mounted on the upper end of the main shaft 10 of the rotor R in covering relationship to the upper surface of the rotary cylindrical sleeve 12 that faces the intake port 14*a*. The scattering prevention member 62 is of a cup shape complementary to the recess 13 in the rotary cylindrical sleeve 12 and has a flange 62*a* on its upper end which extends along the flat upper surface of the rotary cylindrical sleeve 12. The scattering prevention member 62 has an internally threaded hole defined in a bottom thereof. The main shaft 10 has a fixed portion 10*a* at the upper end thereof and having an externally threaded surface. The scattering prevention member 62 is fastened to the main shaft 10 by the fixed portion 10*a* that is threaded into the internally threaded hole in the scattering prevention member 62. The scattering prevention member 62 may alternatively be fastened to the main shaft 10 or the rotary cylindrical sleeve 12 by other fasteners such as bolts.

With the turbo-molecular pump according to the fifth embodiment, since the scattering prevention member 62 is mounted on the rotor R, it is not necessary to provide an obstacle which would otherwise extend across the intake port 14*a* for installing the scattering prevention member 62. Therefore, the velocity of the gas that is evacuated by the turbo-molecular pump is not lowered. Furthermore, because the scattering prevention member 62 is disposed in covering relationship to the recess 13 where fragments of the rotor R tend to be scattered, the scattering prevention member 62 is effective to efficiently prevent fragments of the rotor R from being scattered. While the scattering prevention member 62 is disposed in covering relationship to the rotary cylindrical sleeve 12 in the illustrated embodiment, the scattering prevention member 62 may be disposed so as to cover part of the rotor blades 30.

Figure 9:
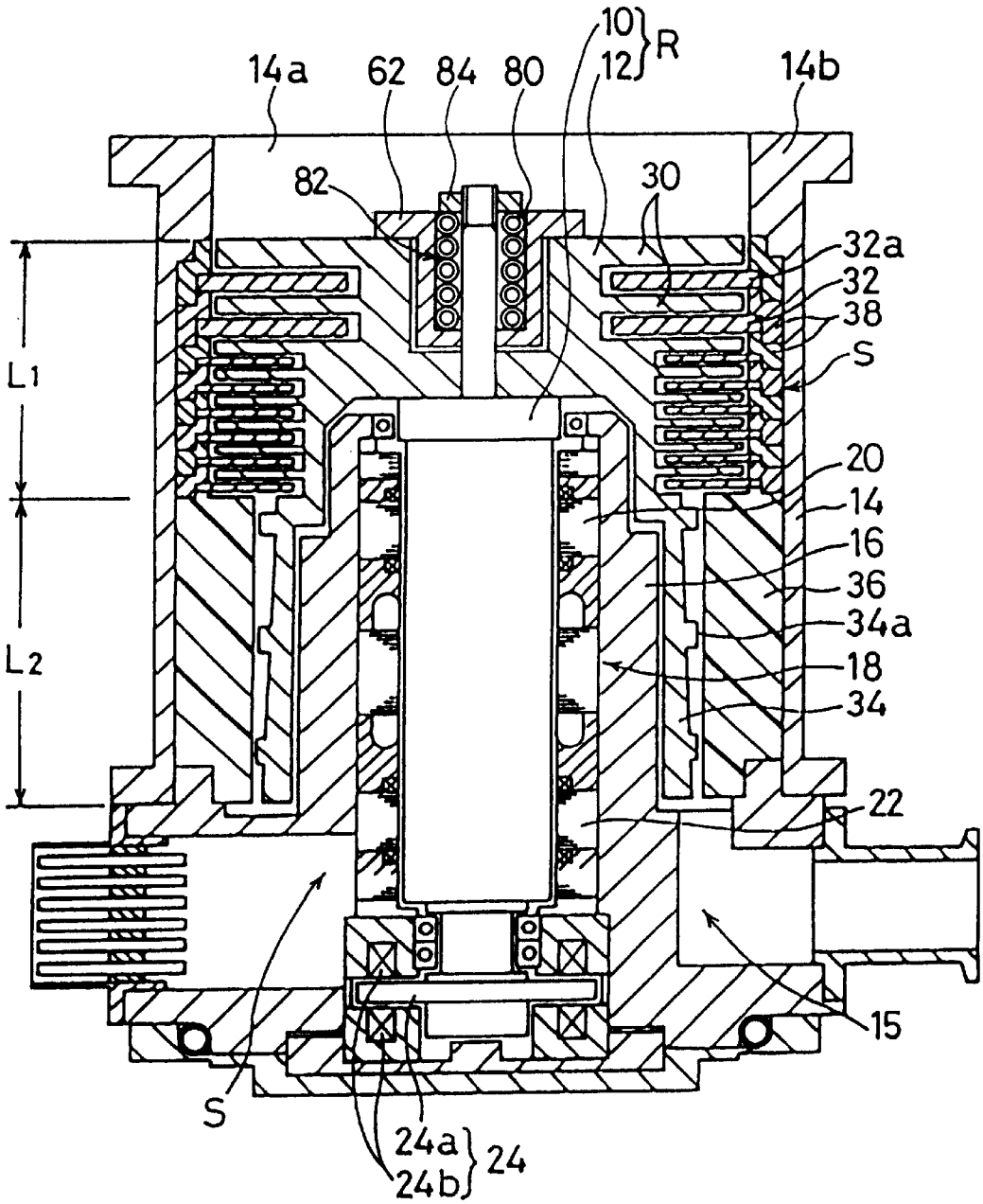
FIG. 9 is an axial cross-sectional view of a turbo-molecular pump according to a sixth embodiment of the present invention.
Figure 10:
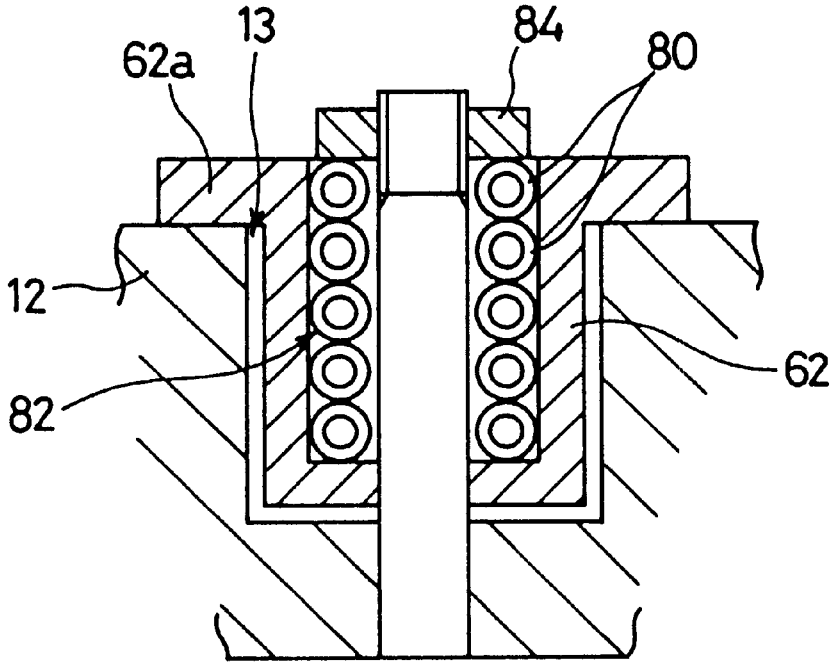
FIG. 10 is an enlarged fragmentary cross-sectional view of the turbo-molecular pump shown in FIG. 9.
Figure 11:
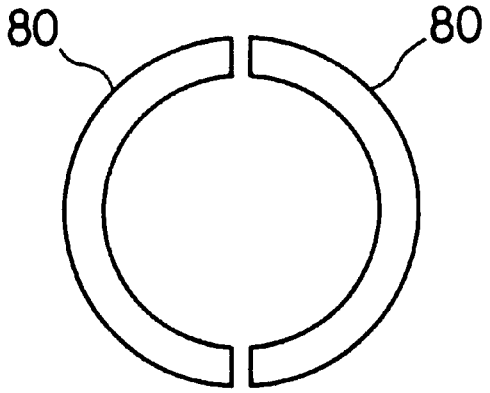
FIG. 11 is a plan view of metal pipes of a shock absorbing member used in the turbo-molecular pump shown in FIG. 9.

FIGS. 9 through 11 show a turbo-molecular pump according to a sixth embodiment of the present invention. The turbo-molecular pump according to the sixth embodiment differs from the turbo-molecular pump according to the fifth embodiment in that a shock absorbing structure is added to the scattering prevention member 62 according to the fifth embodiment. Other details of the turbo-molecular pump according to. the sixth embodiment are identical to those of the turbo-molecular pump according to the fifth embodiment.

In the sixth embodiment, the upwardly open scattering prevention member 62 houses therein a shock absorbing member 82 comprising a pair of vertical stacks of semiannular metal pipes 80 (see FIG. 11) in radially confronting relationship to each other. The main shaft 10 has a vertical extension having an externally threaded upper end. A nut 84 as a shock absorbing member holder is threaded over the externally threaded upper end of the extension of the main shaft 10, thus holding the shock absorbing member 82 against removal. The nut 84 is fastened to cause the shock absorbing member 82 to press the lower surface of the flange 62*a* thereof against the rotary cylindrical sleeve 12 for thereby securing the scattering prevention member 62.

If the rotor R is broken, then fragments of the rotor blades 30 or the rotary cylindrical sleeve 12 collide with the scattering prevention member 62. At this time, the shock absorbing member 82 can easily be deformed or broken in both axial and radial directions to absorb applied shocks. Therefore, the kinetic energy of the fragments is absorbed to protect the chamber or the like to which the turbo-molecular pump is connected.

The semiannular metal pipes 80 are used to make up the shock absorbing member 82 for the reason of better productivity. Alternatively, fully circular metal pipes, annular metal pipes with open gaps, or coil-shaped metal pipes may also be employed. The shock absorbing member 82 may alternatively be made of a relatively soft metal material, a polymer material, or a composite material thereof, and shaped so as to be effective to absorb shocks.

Figure 12:
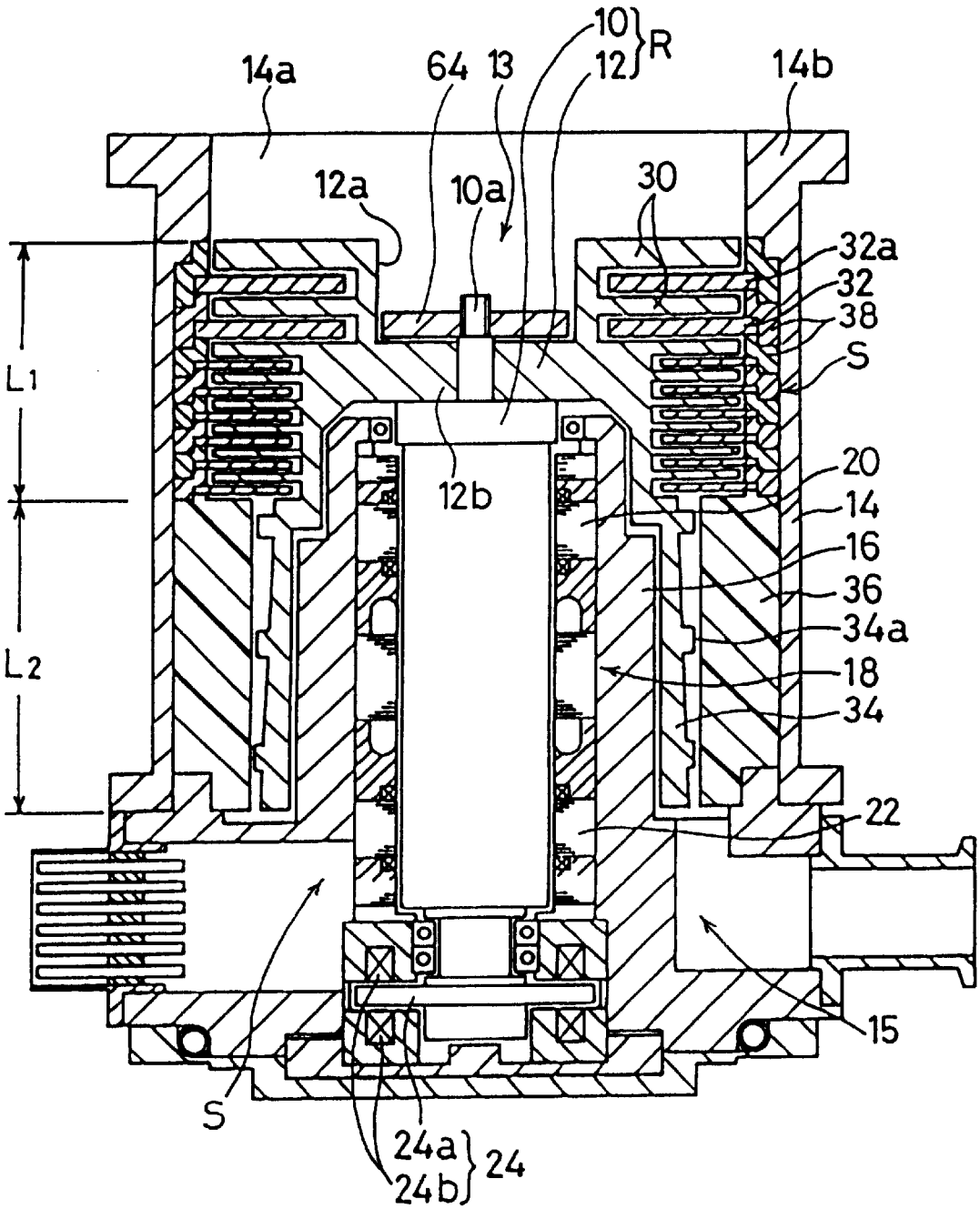
FIG. 12 is an axial cross-sectional view of a turbo-molecular pump according to a seventh embodiment of the present invention.

FIG. 12 shows a turbo-molecular pump according to a seventh embodiment oft he present invention. The turbo-molecular pump according to the seventh embodiment differs from the turbo-molecular pump according to the fifth embodiment in that the cup-shaped scattering prevention member 62 is replaced with a disk-shaped scattering, prevention member 64 that is housed in the recess 13 in the rotary cylindrical sleeve 12. Other details of the turbo-molecular pump according to the seventh embodiment are identical to those of the turbo-molecular pump according to the fifth embodiment. Usually, the rotary cylindrical sleeve 12 has an upper portion 12*a* integral with a hub 12*b* thereof. Therefore, only by simply holding the hub 12*b* with the disk-shaped scattering prevention member 64, rotor fragments are effectively prevented from being scattered. The turbo-molecular pump according to the seventh embodiment is less costly than the turbo-molecular pump according to the fifth embodiment.

Figure 13:
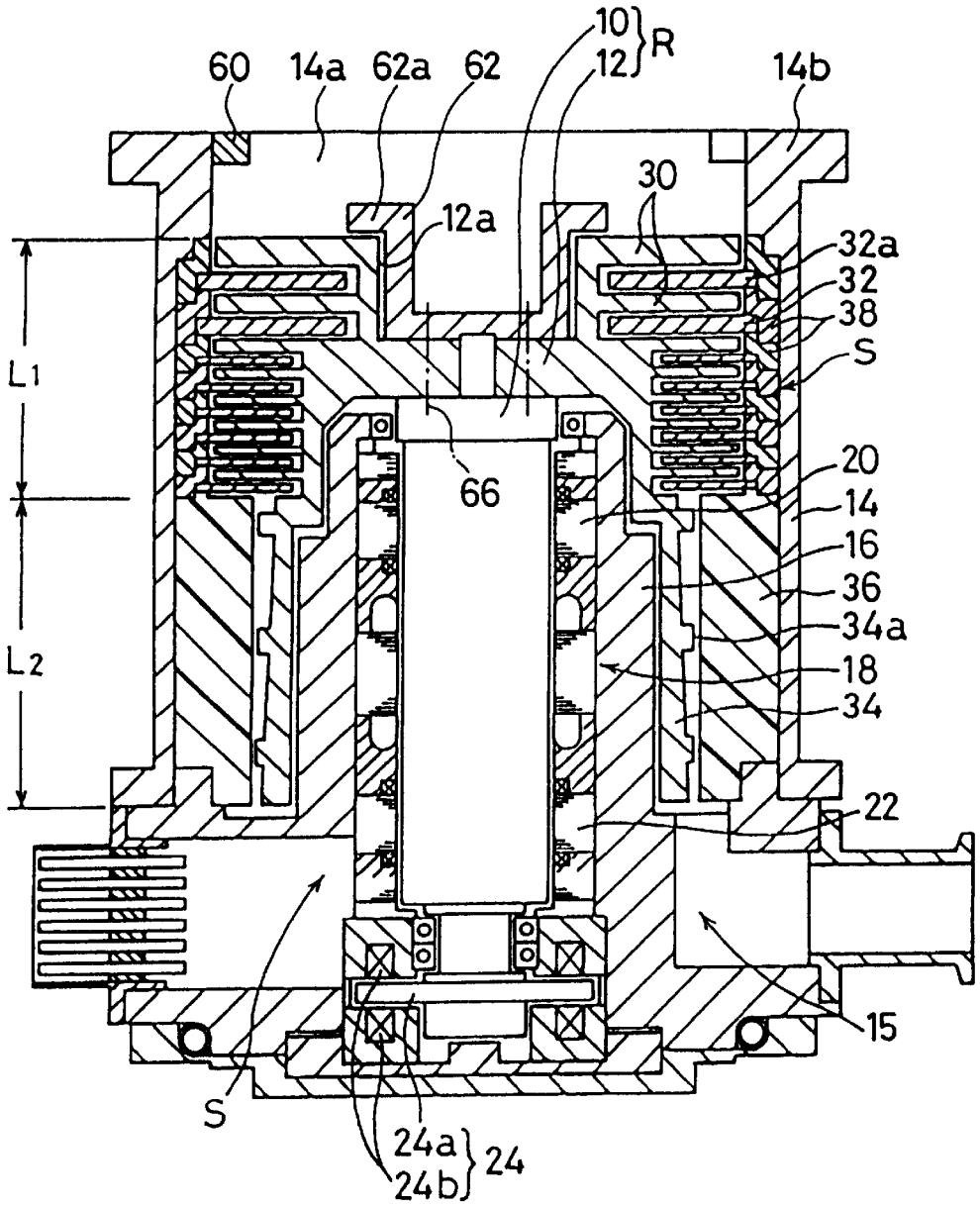
FIG. 13 is an axial cross-sectional view of a turbo-molecular pump according to an eighth embodiment of the present invention.

FIG. 13 shows a turbo-molecular pump according to an eighth embodiment of the present invention. The turbo-molecular pump according to the eighth embodiment differs from the turbo-molecular pump according to the fifth embodiment in that the cup-shaped scattering prevention member 62 is fastened to the rotary cylindrical sleeve 12 by bolts 66 and also differs therefrom in the following: A plurality of (three in the illustrated embodiment) protrusions 60, which make up a scattering prevention member together with the scattering prevention member 62, are disposed at predetermined intervals on an inner surface of the intake port 14*a* and project radially inwardly in covering relationship to the outer circumferential edges of the rotor blades 30 of the rotor R.

With the turbo-molecular pump according to the eighth embodiment, if the rotor R is broken, then fragments of the rotor blades 30 or the rotary cylindrical sleeve 12 collide with not only the scattering prevention member 62 but also the protrusions 60, thus reducing the kinetic energy of the fragments introduced into the intake port 14*a*. In all the embodiments, the scattering prevention member including the protrusions should preferably be made of a high-strength material such as stainless steel, titanium alloy, or the like.

Figure 15:
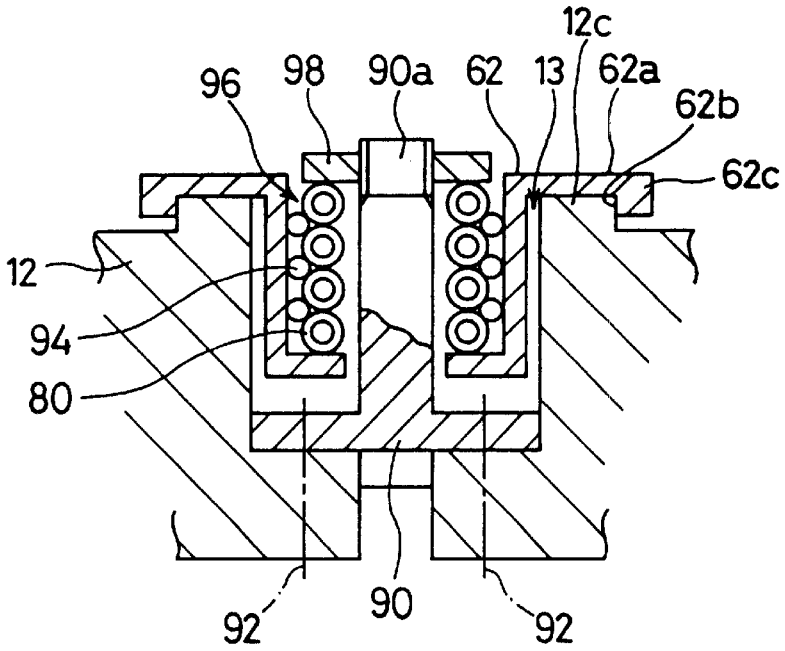
FIG. 15 is an enlarged fragmentary cross-sectional view of the turbo-molecular pump shown in FIG. 14.
Figure 14:
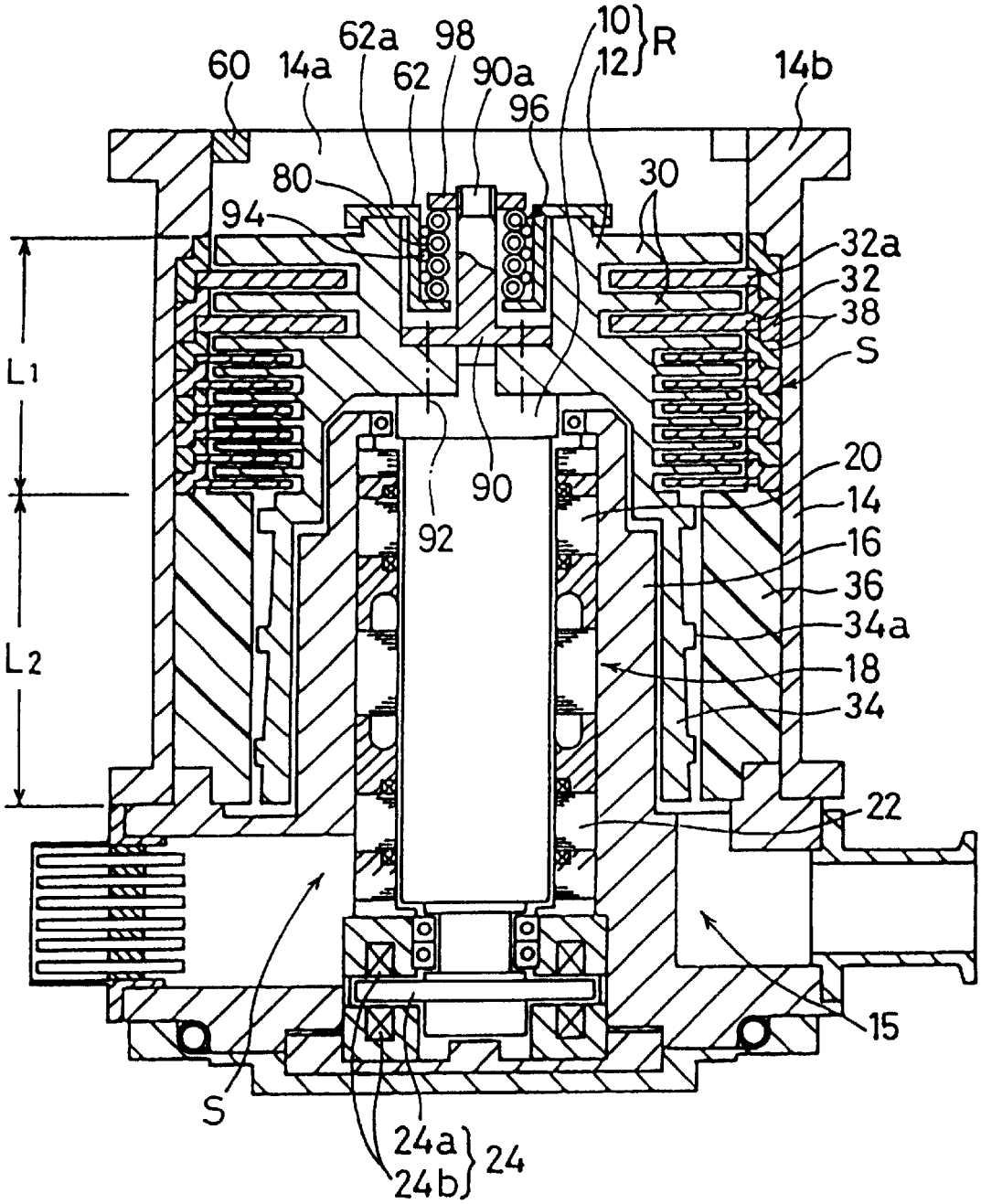
FIG. 14 is an axial cross-sectional view of a turbo-molecular pump according to a ninth embodiment of the present invention.

FIGS. 14 and 15 show a turbo-molecular pump according to a ninth embodiment of the present invention. The turbo-molecular pump according to the ninth embodiment differs from the turbo-molecular pump according to the eighth embodiment in that a shock absorbing structure is added to the scattering prevention member 62 fastened to the rotary cylindrical sleeve 12 according to the eighth embodiment. Other details of the turbo-molecular pump according to the ninth embodiment are identical to those of the turbo-molecular pump according to the eighth embodiment.

In the ninth embodiment, a support 90 having a shank 90*a* is vertically mounted in the recess 13 in the rotary cylindrical sleeve 12 and fastened to the bottom of the recess 13 by bolts 92. The scattering prevention member 62 houses therein a shock absorbing member 96 comprising a pair of vertical stacks of semiannular metal pipes 80 (see FIG. 11) in radially confronting relationship to each other and a plurality of O-rings 94 of fluororubber interposed between the pipes 80 and the scattering prevention member 62. The shank 90*a* has a vertical extension having an externally threaded upper end. A nut 98 as a shock absorbing member holder is threaded over the externally threaded upper end of the extension of the shank 90*a,* thus holding the shock absorbing member 96 against removal. The scattering prevention member 62 is limited against its axial movement by the pipes 80 and limited against its radial movement by the O-rings 94. The shock absorbing structure is capable of absorbing shocks due to collision with rotor fragments or stator fragments in both the axial and radial directions.

As shown in FIG. 15, an annular ledge 12*c* is disposed on the upper surface of the rotary cylindrical sleeve 12 around the recess 13, and an annular ridge 62*c* is disposed on the lower surface of a peripheral edge of the flange 62*a* of the scattering prevention member 62. The annular ridge 62*c* define a recess 62*b* in the lower surface of the flange 62*a*. When the annular ledge 12*c* is fitted in the recess 62*b* in the lower surface of the flange 62*a,* the scattering prevention member 62 is coaxially aligned with the rotary cylindrical sleeve 12 and held against radial movement.

With the turbo-molecular pump according to the ninth embodiment, if the rotor R is broken, fragments of the rotor blades 30 or the rotary cylindrical sleeve 12 collide with the scattering prevention member 62. At this time, the shock absorbing member 96 is deformed or broken to absorb the kinetic energy of the fragments. Since fragments also collide with the protrusions 60, the kinetic energy of the fragments introduced into the intake port 14*a* can further be reduced.

Figure 16:
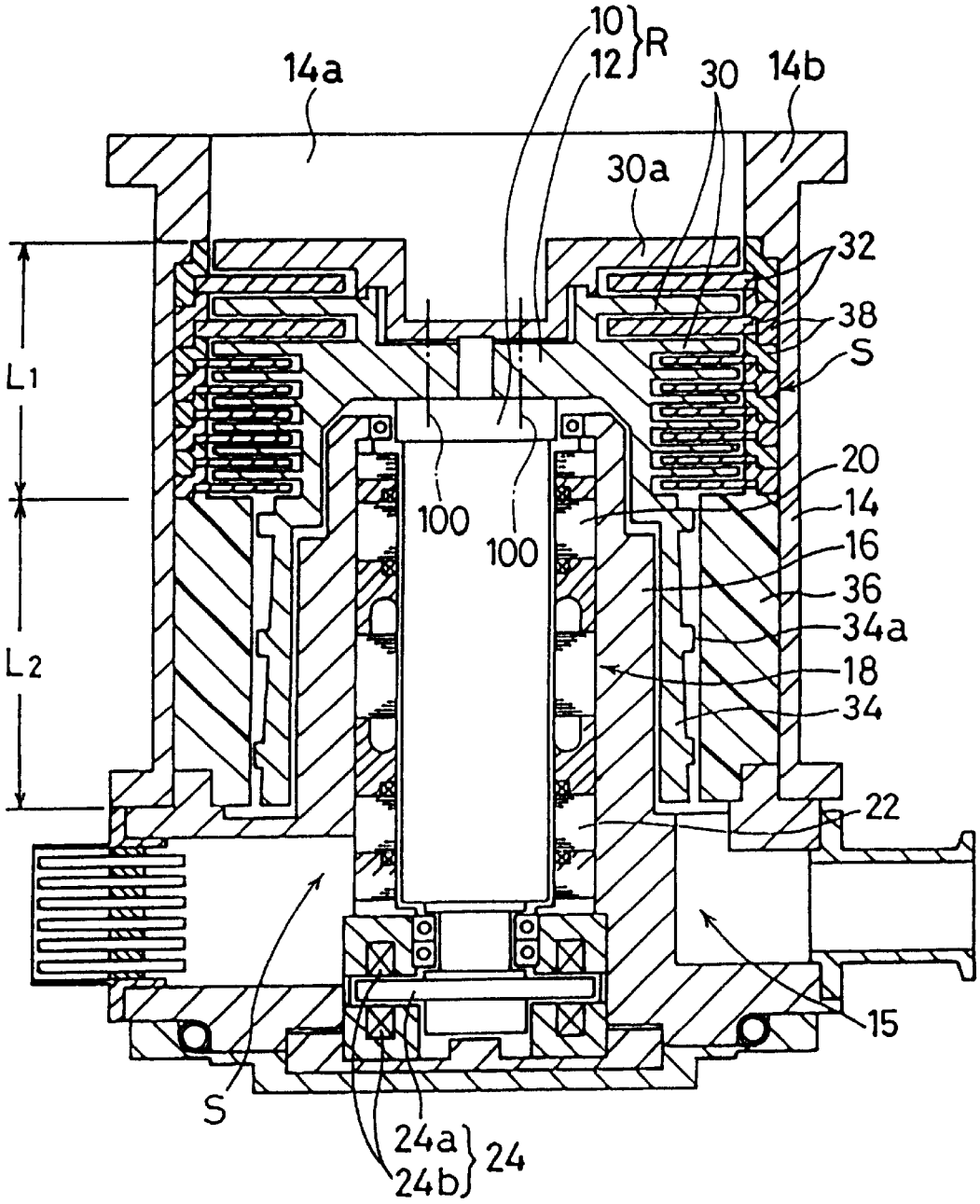
FIG. 16 is an axial cross-sectional view of a turbo-molecular pump according to a tenth embodiment of the present invention.

FIG. 16 shows a turbo-molecular pump according to a tenth embodiment of the present invention. According to the tenth embodiment, the axially uppermost rotor blade 30*a* of all rotor blades 30 is separate from the other rotor blades 30 and is made of a material stronger than aluminum, such as stainless steel, titanium alloy, or the like, and the remaining rotor blades 30 are made of aluminum. The uppermost rotor blade 30*a* is directly fastened to the main shaft 10 by bolts 100, and serves as a scattering prevention member.

Since the uppermost rotor blade 30*a* is made of a material stronger than aluminum, the rotor blade 30*a* is not broken or is broken to a lesser degree when it is hit by fragments of the remaining rotor blades 30 made of aluminum. The rotor blade 30*a* thus effectively serves as a scattering prevention member for preventing fragments from being scattered through the intake port 14*a*.

Figure 17:
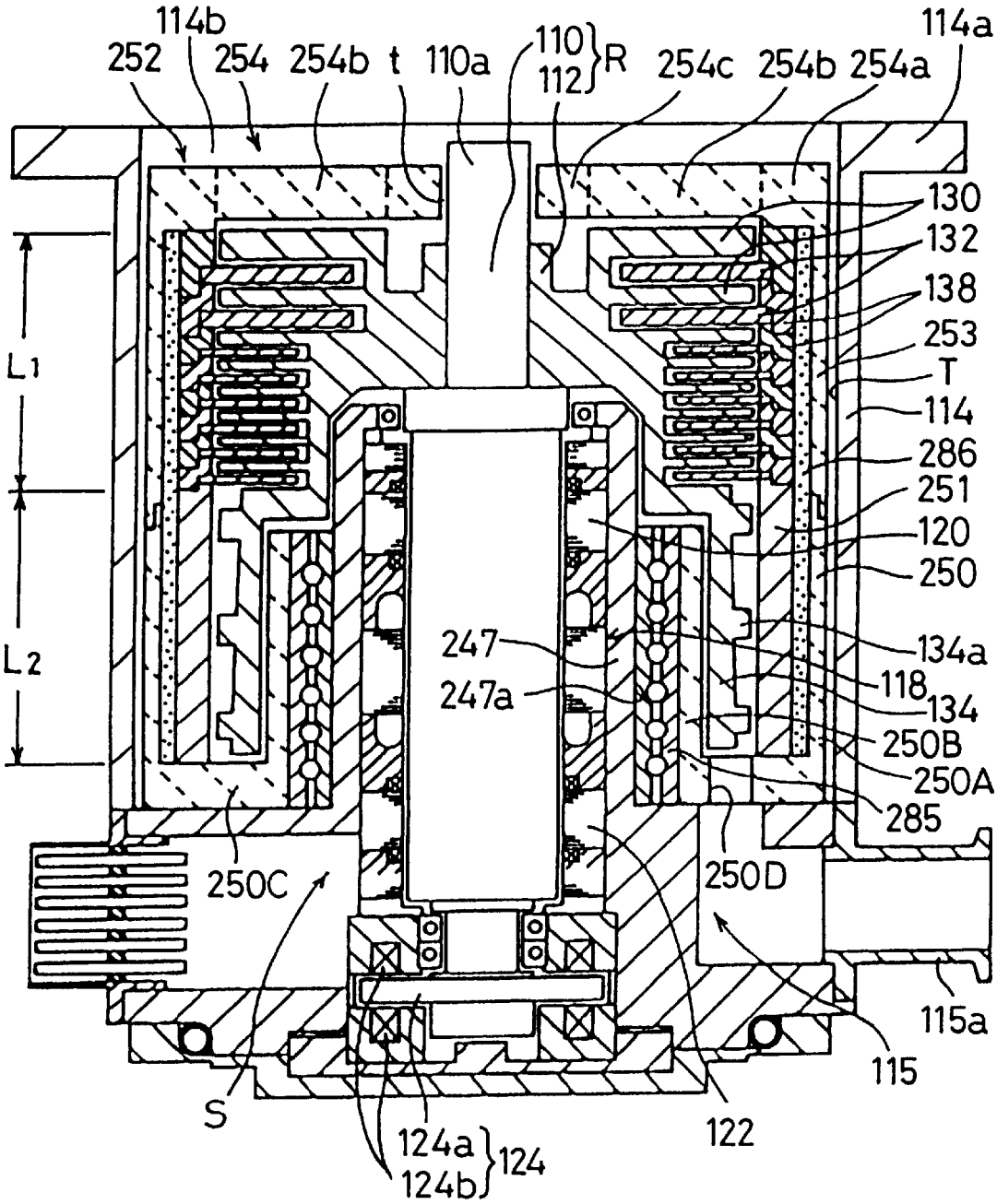
FIG. 17 is an axial cross-sectional view of a turbo-molecular pump according to an eleventh embodiment of the present invention.
Figure 18:
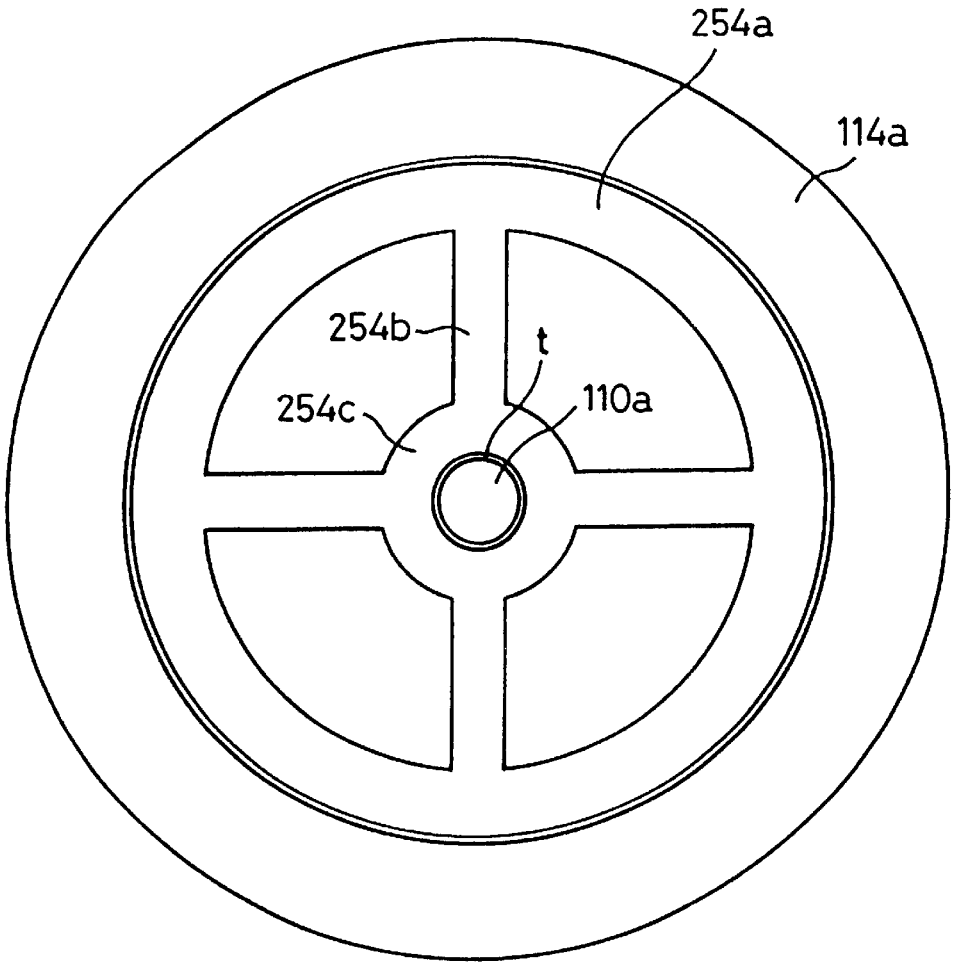
FIG. 18 is a plan view of the turbo-molecular pump shown in FIG. 17.

FIGS. 17 and 18 show a turbo-molecular pump according to an eleventh embodiment of the present invention.

The turbo-molecular pump comprises a cylindrical pump casing 114 housing a blade pumping section L1 and a groove pumping section L2 which are constituted by a rotor (rotation member) R and a stator (stationary member) S. The bottom portion of the pump casing 114 is covered by a base section 115 which is provided with an exhaust port 115*a*. The top portion of the pump casing 114 is provided with a flange section 114*a* for coupling the turbo-molecular pump to an apparatus or a piping to be evacuated. The stator S comprises a stator cylinder section 247 provided on the center of the base section 115, and stationary sections of the blade pumping section L1 and the groove pumping section L2.

The rotor R comprises a rotor cylinder section 112 attached to a main shaft 110 which is inserted into the stator cylinder section 247. Between the main shaft 110 and the stator cylinder section 247, there are provided a drive motor 118, an upper radial bearing 120 and a lower radial bearing 122 disposed on the upper and lower sides of drive motor 118, respectively. At the lower part of the main shaft 110, there is provided an axial bearing 124 having a target disk 124*a* at the bottom end of the main shaft 110 and an upper and lower electromagnet 124*b* on the stator side. In this configuration, the rotor R can be rotated at a high speed under a five coordinate active control system.

Rotor blades (rotor vanes) 130 are provided integrally with the upper external surface of the rotor cylinder section 112, and on the inside of the pump casing 114, stator blades (stator vanes) 132 are provided in such a way to alternately interweave with the rotor blades 130. These blade members constitute the blade pumping section L1 which carries out gas evacuation by cooperative action of the high-speed rotor blades 130 and the stationary stator blades 132. Below the blade pumping section L1, the groove pumping section L2 is provided. The groove pumping section L2 comprises a spiral (groove section 134 having spiral grooves 134*a* on the outer surface of the lower portion of the rotor cylinder section 112, and the stator S comprises a spiral groove section spacer 251 surrounding the spiral groove section 134. Gas evacuation action of the groove pumping section L2 is caused by the dragging effect of the spiral grooves 134*a* of the spiral groove section 134.

By providing the groove pumping section L2 downstream of the blade pumping section L1, a wide-range of the turbo-molecular pump can be constructed so as to enable evacuation over a wide range of gas flow rates using one pumping unit. In this example, the spiral grooves of the groove pumping section L2 are provided on the rotor side of the pump structure, but the spiral grooves may be formed on the stator side of the pump structure.

The blade pumping section L1 comprises alternating rotor blades 130 and stator blades 132, and the groove pumping section L2 comprises the spiral groove section 134 and the groove pumping section spacer 251. The pump casing 114 is used to press down the stator blades 132, the stator blade spacers 138 and the groove pumping section spacer 251.

In this embodiment, the lower inner casing 250 and the spiral groove section spacer 251 are separately provided. That is, the stacked assembly comprising the stator blades 132 and the stator blade spacers 138, and the spiral groove section spacer 251 are fixedly held by a lower inner casing 250 and an upper inner casing 253, which are mutually fitted to construct an inner casing 252.

An impact absorbing member 286 is provided between the inner surfaces of the lower inner casing 250 and the upper inner casing 253, and the outer surfaces of the stator blade spacers 138 and the spiral groove section spacer 251. The impact absorbing member 286 is made of a material such as relatively soft metal, high polymer, or composite material thereof.

The lower inner casing 250 comprises an outer cylindrical portion 250A and an inner cylindrical portion 250B connected by a connecting portion 250C having a communicating hole 250D. A friction reducing structure (mechanical bearing) 285 is provided between the inner surface of the inner cylindrical portion 250B and the outer surface 247*a* of the stator cylinder section 247 of the stator S.

In this embodiment, since a clearance T is formed between the inner casing 252 and the pump casing 114, even when a part of the inner casing 252 is broken or deformed, the impact is not directly transmitted to the pump casing 114 to thus prevent breakage of the pump casing 114 or its connection with other facilities or devices.

In this embodiment, since the impact absorbing member 286 is provided between the lower inner casing 250 and the upper inner casing 253, and the stator blade spacers 138 and the spiral groove section spacer 251, the amount of impact force transmitted to the inner casing 252 is reduced, which has been transmitted from the rotor R to the stator blade spacers 138 etc. Thus, the protection function of the inner casing 252 is improved, and hence the clearance T between the upper inner casing 253 or the lower inner casing 250 and the pump casing 114 can be smaller to enable the overall pump to be compact.

As shown in FIGS. 17 and 18, in this embodiment, another impact absorbing structure 254 is provided at the upstream of the blade pumping section L1, i.e., at an intake port 114*b* of the turbo-molecular pump shown in FIG. 17. Specifically, an extended portion 110*a* is provided at the top of the main shaft 110, and an annular suppressing portion 254*a* is formed at the top of the upper inner casing 253. Stay members 254*b* are provided to inwardly protrude from the annular suppressing portion 254*a* and are connected to a ring-shaped upper inner cylindrical portion 254*c*. The ring-shaped upper cylindrical portion 254*c* surrounds the extended portion 110*a* with a small gap t.

With the turbo-molecular pump according to the eleventh embodiment, the separate impact absorbing structure 254 is provided at the upstream of the blade pumping section L1, i.e., at the intake port 114*b* of the turbo-molecular pump. The impact absorbing structure 254 serves as a scattering prevention member for preventing fragments of the rotor from being scattered through the intake port 114*b*.

Figure 19:
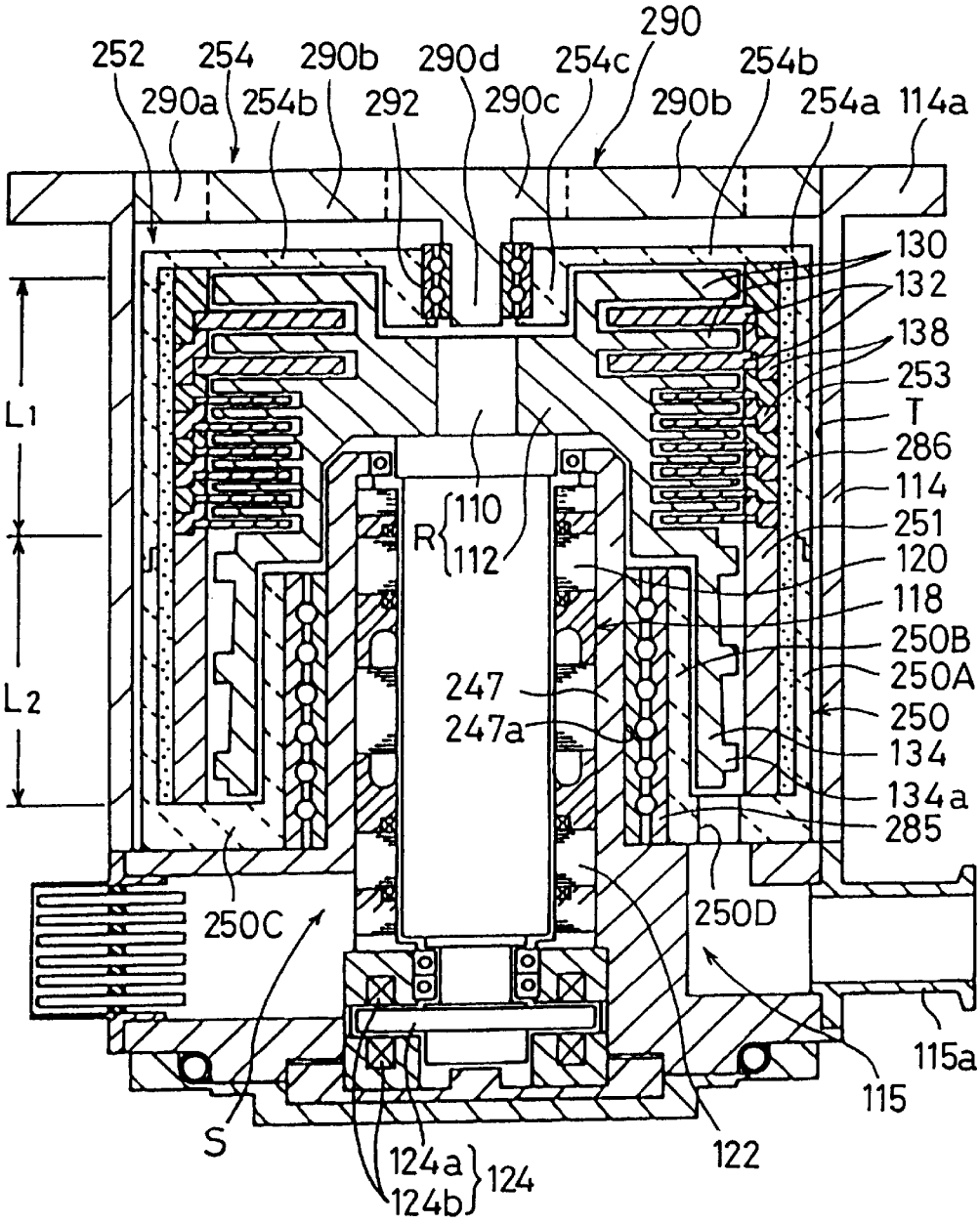
FIG. 19 is an axial cross-sectional view of a turbo-molecular pump according to a twelfth embodiment of the present invention.
Figure 20:
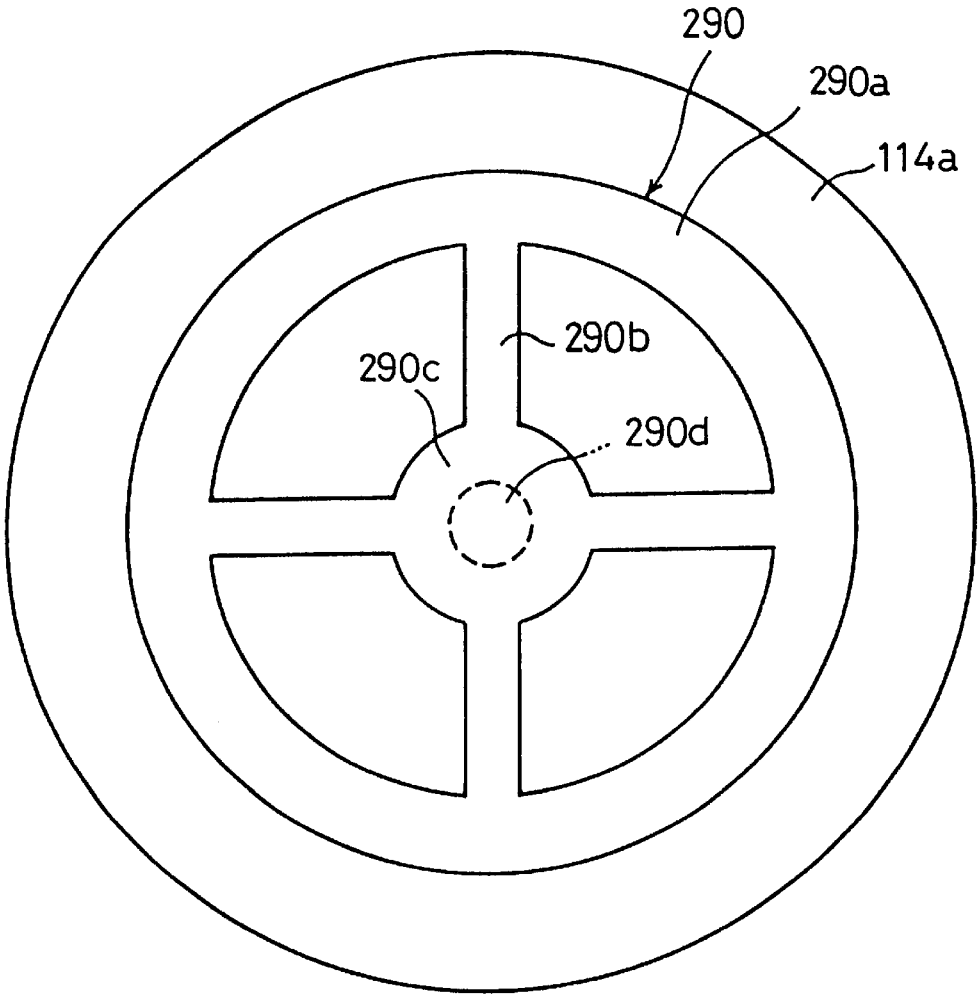
FIG. 20 is a plan view of the turbo-molecular pump shown in FIG. 19.

FIGS. 19 and 20 show a turbo-molecular pump according to a twelfth embodiment of the present invention. In this embodiment, the impact absorbing structure 254 at the entrance is mounted on a shaft body fixed to the stator S by way of friction reducing structure. That is, the upper end of the main shaft 110 is shorter, and a bearing supporting member 290 is provided to protrude inwardly from the top inner surface of the pump casing 114.

The bearing supporting member 290 comprises an annular section 290*a*. fixed to the pump casing 114, stay members 290*b* extending radially inwardly from the annular section 290*a*, a disc 290*c* connected to the stay members 290*b* at the central region, and a cylindrical shaft 290*d* extending downward from the disc 290*c*. On the other hand, rectangular plate-like stay members 254*b* are provided to radially inwardly extend from the annular suppressing portion 254*a* of the upper inner casing 253, and an upper inner cylindrical portion 254*c* is formed at the central region of the stay members 254*b* above the main shaft 110. A mechanical bearing (friction reducing mechanism) 292 is provided between the outer surface of the shaft 290*d* and the upper inner cylindrical portion 254*c*.

The impact absorbing structure 254 serves as a scattering prevention member for preventing fragments of the rotor from being scattered through the intake port 114*b*. The bearing supporting member 290 also serves as a scattering prevention member for preventing fragments of the rotor from being scattered through the intake port 114*b*.

As described above, according to the eleventh and twelfth embodiments shown in FIGS. 17 through 20, if the rotor is broken, then fragments of the rotor, e.g., a rotary cylindrical sleeve and rotor blades, or fragments of the stator, e.g., stator blades, are blocked by the scattering prevention member, or lose the kinetic energy toward the intake port. Therefore, the scattering prevention member is effective to prevent those fragments from damaging the chamber in a processing apparatus connected to the intake port or devices and products being processed in the chamber.

As described above, the various embodiments of the present invention are applied to the wide-range turbo-molecular pump which has the turbine blade pumping section L1 and the thread groove pumping section L2. However, the principles of the present invention are also applicable to a turbo-molecular pump having either the turbine blade pumping section L1 or the thread groove pumping section L2. Furthermore, the various embodiments of the present invention may be used in any one of possible combinations.

With the present invention, as described above, while the rotor is rotated, fragments of the rotary cylindrical sleeve or the rotor blades produced when the rotor is broken collide with the scattering prevention member and are prevented from being scattered through the intake port, or lose their kinetic energy. Thus, those fragments are prevented from causing damage to the chamber connected to the intake port or devices and products being processed in the chamber. Therefore, even if the rotor is broken, the turbo-molecular pump effectively prevents accidents which would otherwise lead to damage to the chamber or destruction of the evacuating system. Consequently, the turbo-molecular pump according to the present invention is highly safe while it is in operation.

Although certain preferred embodiments of the present invention have been shown and described in detail, it should be understood that various changes and modifications may be made therein without departing from the scope of the appended claims.

What is claimed is:

1. A turbo-molecular pump comprising:

a casing having an intake port;

a stator fixedly mounted in said casing;

a rotor with a main shaft being supported in said casing for rotation relative to said stator, said stator and said rotor serving as at least one of a turbine blade pumping section and a groove pumping section for evacuating gas; and a scattering prevention member comprising at least one blade for preventing fragments of at least one of said rotor and said stator from being scattered through said intake port;

wherein said at least one blade of the scattering prevention member is located at an axially uppermost position relative to said rotor and is made of a material stronger than a material that the rotor is made of; and wherein the scattering prevention member is directly mounted to the main shaft of the rotor.

2. A turbo-molecular pump according to claim 1, wherein said rotor comprises rotor blades and said stator comprises stator blades, and said at least one blade of said scattering prevention member serves a same purpose as said rotor blades.

3. A turbo-molecular pump according to claim 1, wherein said scattering prevention member is made of a high-strength material.

4. A turbo-molecular pump comprising:

a casing having an intake port;

a stator fixedly mounted in said casing;

a rotor supported in said casing for rotation relative to said stator, said stator and said rotor serving as at least one of a turbine blade pumping section and a groove pumping section for evacuating gas; and a scattering prevention member comprising at least one blade for preventing fragments of at least one of said rotor and said stator from being scattered through said intake port, wherein said rotor comprises rotor blades and said stator comprises stator blades, and said at least one blade of said scattering prevention member serves a same purpose as said rotor blades;

wherein said at least one blade of the scattering prevention member is located at an axially uppermost position relative to said rotor and is made of a material stronger than a material that the rotor is made of.

* * * * *

UNITED STATES PATENT AND TRADEMARK OFFICE

CERTIFICATE OF CORRECTION

PATENT NO. : 6,589,009 B1
APPLICATION NO. : 09/592411
DATED : July 8, 2003
INVENTOR(S) : Shiokawa et al.

It is certified that error appears in the above-identified patent and that said Letters Patent is hereby corrected as shown below:

On the Front Page, Item (30): Foreign Application Priority Data

Please insert additional five Foreign Application Priority Data as follows:

Jun. 27, 1997 (JP) ... 9-187681
Jan. 27, 1998 (JP) ... 10-29160
Feb. 19, 1999 (JP) ... 11-41039
Jun. 3, 1999 (JP) ... 11-156215
Jul. 4, 1999 (JP) ... 11-200990

In the Claims

Claim 1, Column 12, line 1, please delete “fixedly”.

Claim 4, Column 12, line 29, please delete “fixedly”.

Claim 4, Column 12, line 30, after “rotor”, insert --with a main shaft being--.

Claim 4, Column 12, line 45, after “made of”, insert

--; and wherein the scattering prevention member is directly mounted to the main shaft of the rotor--.

Signed and Sealed this

Twelfth Day of June, 2007

JON W. DUDAS
*Director of the United States Patent and Trademark Office*